United States Patent [19]

Corbett

[11] 4,089,698

[45] May 16, 1978

[54] PROCESS FOR HANDLING ASPHALTENE CONCENTRATES

[75] Inventor: Luke W. Corbett, Mountainside, N.J.

[73] Assignee: Exxon Research & Engineering Co., Linden, N.J.

[21] Appl. No.: 414,776

[22] Filed: Nov. 12, 1973

[51] Int. Cl.[2] ..... C08L 95/00

[52] U.S. Cl. ..... 106/278; 106/283

[58] Field of Search ..... 106/277, 283, 278

[56] References Cited

U.S. PATENT DOCUMENTS 3,305,474 2/1967 Knowles et al. ..... 106/283 X

OTHER PUBLICATIONS

Barth, Asphalt Science and Technology, New York, Gordon and Breach Science Publishers, 1962; pp. 437–447.

Chemical Abstracts, vol. 64, 1966; p. 10996e "Structure Formation in Road Bitumen."

*Primary Examiner*—Lorenzo B. Hayes

*Attorney, Agent, or Firm*—Byron O. Dimmick

[57] ABSTRACT

An asphaltene concentrate characterized by its high softening point and by its high viscosity when in the liquid state is rendered into a pumpable form at ambient temperatures by conducting the asphaltene concentrate in liquid state directly from the precipitation zone at a high temperature, or from an intermediate heating zone wherein it attains a sufficiently high temperature, into a moving stream of water, whereupon the asphaltene concentrate immediately solidifies into lumpy or string-like particles. These particles are mixed with water and the mixture is subjected to a grinding operation which converts it to a thick suspension or semipaste which is thixotropic in nature and exhibits an apparent low viscosity at ambient temperatures, making it readily pumpable.

5 Claims, 1 Drawing Figure

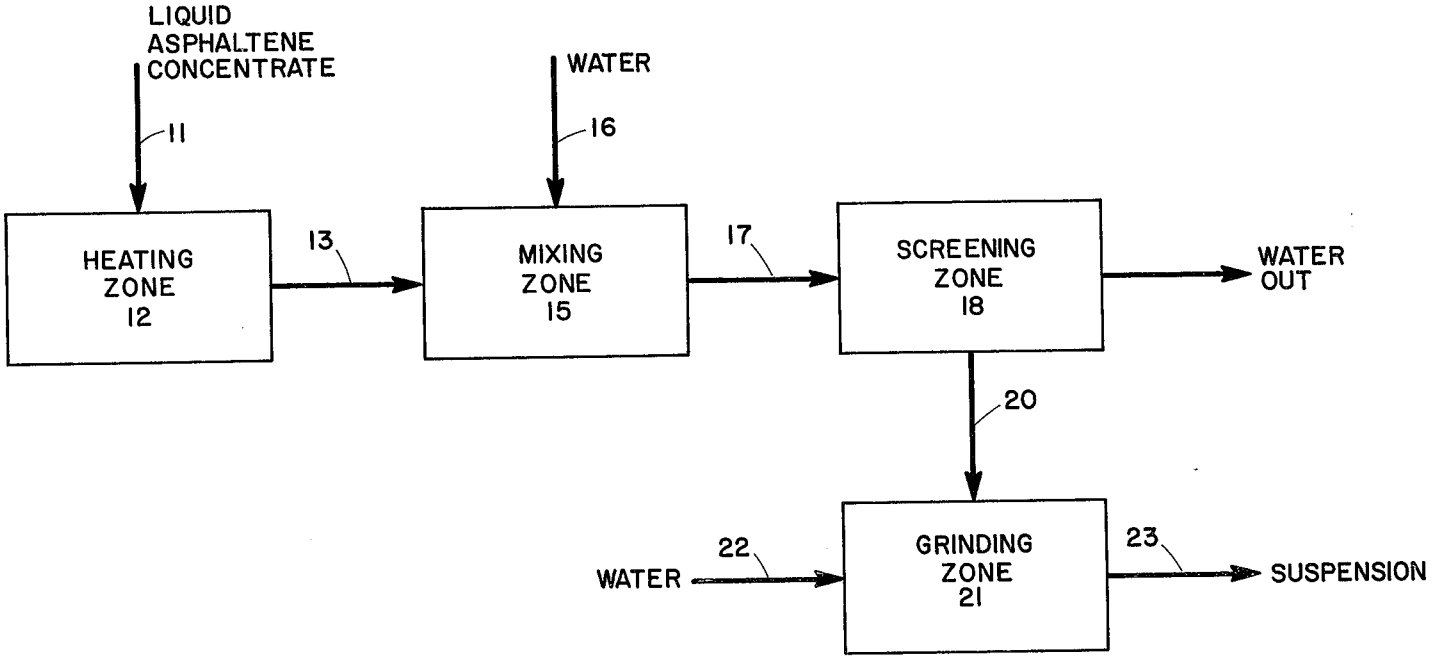
LIQUID ASPHALTENE CONCENTRATE
11
HEATING ZONE 12
13
WATER
16
MIXING ZONE 15
17
SCREENING ZONE 18
WATER OUT
20
GRINDING ZONE 21
22
WATER
23
SUSPENSION

PROCESS FOR HANDLING ASPHALTENE CONCENTRATES

FIELD OF THE INVENTION

This invention relates to a process for handling asphaltene concentrates in a fluidized or pumpable form so as to avoid the high costs that are associated with handling solids. Asphaltene concentrates, e.g., those obtained by pentane treatment of a petroleum residuum, separate out in liquid phase as contrasted with the separation of asphaltenes obtained for example by treating a petroleum residuum with heptane, wherein the asphaltenes separate as precipitated solids. It is a relatively minor problem to separate precipitated solids whereas the handling of asphaltene concentrates constitutes an obvious problem because of their solid nature at ambient temperatures, their high softening points, and their high viscosity at high temperatures.

DESCRIPTION OF THE PRIOR ART

It is known as taught for example in U.S. Pat. No. 3,087,887 to separate asphaltenes from a petroleum residuum by treatment of a petroleum residuum with normal hexane or normal heptane at ordinary temperatures and pressures, which causes the asphaltenes to separate and form a slurry of asphaltenes and a solvent and oil solution. The asphaltenes thus separated can be removed from the slurry by running the slurry through a centrifuge. It is also known to prepare an asphaltene concentrate containing polar aromatics as well as asphaltenes by treating an asphaltic residuum with pentane or isopentane at high temperatures and pressures by the procedure taught for example in U.S. Pat. No. 2,940,920. In the latter process the asphaltene concentrate separates as a liquid phase rather than as precipitated solids.

SUMMARY OF THE INVENTION

The present invention provides a process for conveniently handling asphaltene concentrates which are liquid at the temperature of separation but solid at ordinary temperatures and which ordinarily present problems in handling when the liquid material is permitted to cool and solidify.

DETAILED DESCRIPTION OF THE INVENTION

The asphaltene concentrates that are handled in the process of the present invention comprise mixtures of from 40 to 90 weight percent of heptane-insoluble asphaltenes and from 10 to 60 weight percent of polar aromatics. The definitions of asphaltenes and polar aromatics are given in *Analytical Chemistry,* Volume 41, page 576 (April, 1969). Asphaltene concentrates containing polar aromatics are obtained in the liquid phase by treatment of asphaltic residua with paraffinic hydrocarbons at elevated temperatures and pressures. While it is possible as shown in U.S. Pat. No. 2,940,920 to prepare such concentrates with paraffin hydrocarbons having from 5 to 8 carbon atoms, provided that suitable pressures and temperatures are used, it is preferred to prepare such concentrates by treatment of an asphaltic residuum with pentane or isopentane at a temperature within the range of about 175° to 400° F. Such asphaltene concentrate will have a melting point higher than 300° F.

In the accompanying drawing there is presented a flow diagram of the process of this invention. An asphaltene concentrate in liquid state, as for example the separated asphaltene concentrate liquid phase from the pentane treatment of an asphaltic residuum, is conducted by means of line 11 into a heating zone 12 wherein the asphaltene concentrate is heated to a temperature within the range of about 400 to 600° F. If the concentrate is already at this temperature this step is of course not necessary. The heated concentrate is then conducted by means of line 13 into a mixing zone 15 wherein it is contacted with a moving stream of water introduced into the zone through line 16. The temperature of this stream of water should be sufficiently low to cause the liquid asphaltene concentrate to solidify as particulate lumps or strings. Generally water at ambient temperatures, e.g., 40° to 100° F. would be used. Upon contacting the water the asphaltene concentrate immediately solidifies into small lumps and string-like particles. The resulting mixture of solidified asphaltenes and water is conducted by means of line 17 into a screening zone 18 to separate the particles from the stream of water. The particles are then passed by conveyer 20 into a grinding zone 21 where they are mixed with a metered quantity of water introduced through line 22. The grinding of the particles in the presence of the water produces a suspension of ground asphaltene concentrate in water which can be removed from the grinding zone through line 23 for further handling.

The screening zone 18 can contain a conventional shaker screen sloping downwardly toward an exit opening through which the particles are dumped onto conveyer 20, or the screen can comprise an endless-belt-type screen which can then also serve as the conveyor 20, discharging the screened particles directly into the grinder 21. If the shaker screen embodiment is used, conveyer 20 can be simply a chute feeding into the grinder or it can be an endless belt type conveyor, for example. The screen in zone 18 is preferably one having openings within the range of about ¼ inch down to about 20 mesh.

Examples of suitable grinders in zone 21 include hammer mills, roller mills or jaw type crushers all of which are well known in the art. Hammer mills are preferred. The screen used in the hammer mill, the roll clearance in the roller mill, or the jaw spacing in the crusher will be such as to produce particles that do not exceed 100 mesh in size, in order that satisfactory suspensions will be provided.

The proportion of water to asphaltene concentrate in the suspension will generally be within the range of about 30 to 80 wt. % of water and about 70 to 20 wt. % of asphaltene concentrate, or more preferably about 40 to 60 wt. % of water and about 60 to 40 wt. % of asphaltene concentrate.

The semipaste or supsension of ground asphaltene concentrate in water can be easily transported to a remote site and used to make a paving composition. For example, the asphaltene suspension can be mixed with a paving aggregate at 350° F. for one minute in a conventional pug mill and thereafter a number 6 fuel oil can be added to the mixture and blended therewith at 350° F. for three additional minutes. The composition of the paving mix can be 2 wt. % of the asphaltene concentrate, 5 wt. % of fuel oil and 93 wt. % of mineral aggregate; see Canadian Pat. No. 828,042 of L. W. Corbett and R. E. Swarbrick.

A representative asphaltene concentrate containing about 66 wt. % of heptane insoluble asphaltenes and about 34 wt. % of polar aromatics and having a softening point of 370° F. and zero penetration at 77° F. can be obtained by controlled normal pentane fractionation (e.g., at about 350° F. and 425 psia pressure) of a residuum from a Langunillas crude oil, the beginning residuum containing about 14 wt. % of heptane insoluble asphaltenes, 37% polar aromatics, 36% of naphthene aromatics and 13% of saturates. The original residuum has a penetration of 90 at 77° F. and a softening point of 115° F.

An asphaltene concentrate containing 66 wt. % of heptane-insoluble asphaltenes and 34 wt. % of polar-aromatics as described above was heated to 500°-600° F., and then injected into a moving stream of water at about 70°-80° F., thereby converting the molten liquid into lumps and stringy particles. The particles were separated from the water on a 20 mesh screen and then mixed with an equal weight of water, and the suspension was ground into a semipaste in which all of the particles were sufficiently small to pass through a 100 mesh screen. This produced a stable pumpable suspension that showed no signs of settling over a period of three months in a covered container.

What is claimed is:

1. A process for preparing a stable aqueous suspension of an asphaltene concentrate, said concentrate having a melting point higher than 300° F and comprising a mixture of from 40 to 90% by weight of heptane-insoluble asphaltenes and from 10 to 60% by weight of polar aromatics, said concentrate having been obtained as a liquid phase by treatment of an asphaltic residuum with a $C_5$ to $C_8$ paraffinic hydrocarbon at elevated temperatures and pressures, which comprises conducting the asphaltene concentrate in liquid state into a moving stream of water, thereby causing the liquid asphaltene concentrate to solidify in the form of particulate lumps or strings, and grinding a mixture of the particulate solids and water into the form of a paste-like suspension.

2. Process as defined by claim 1 wherein said paraffinic hydrocarbon comprises normal pentane or isopentane.

3. Process as defined by claim 1 wherein the temperature of said asphaltene concentrate is within the range of 400°-600° F. when it is conducted into the moving stream of water.

4. Process as defined by claim 1 wherein the paste-like suspension comprises from about 30 to 80 wt. % of water and about 70 to 20 wt. % of the asphaltene concentrate.

5. Process as defined by claim 1 wherein the particulate solids are ground to a size not exceeding 100 mesh.

* * * * *